US009501971B2

(12) United States Patent
Lee

(10) Patent No.: US 9,501,971 B2
(45) Date of Patent: Nov. 22, 2016

(54) ORGANIC LIGHT EMITTING DISPLAY DEVICE AND DRIVING METHOD THEREOF THAT DISPLAYS AN IMAGE BY DIVIDING ONE FRAME INTO A PLURALITY OF SUB-FIELDS

(71) Applicant: Samsung Display Co., Ltd., Yongin, Gyeonggi-Do (KR)

(72) Inventor: Ji-Gong Lee, Yongin (KR)

(73) Assignee: Samsung Display Co., Ltd. (KR)

( * ) Notice: Subject to any disclaimer, the term of this patent is extended or adjusted under 35 U.S.C. 154(b) by 277 days.

(21) Appl. No.: 14/153,640

(22) Filed: Jan. 13, 2014

(65) Prior Publication Data

US 2015/0054721 A1 Feb. 26, 2015

(30) Foreign Application Priority Data

Aug. 22, 2013 (KR) ..... 10-2013-0099805

(51) Int. Cl.
*G09G 3/30* (2006.01)
*G09G 3/32* (2016.01)

(52) U.S. Cl.
CPC .... *G09G 3/3233* (2013.01); *G09G 2300/0842* (2013.01); *G09G 2320/0673* (2013.01)

(58) Field of Classification Search
None
See application file for complete search history.

(56) References Cited

U.S. PATENT DOCUMENTS

2005/0073484 A1* 4/2005 Kim ..... G09G 3/2037 345/63
2010/0117935 A1* 5/2010 Seo ..... G09G 3/2029 345/76
2012/0287144 A1* 11/2012 Gandhi ..... G09G 3/2029 345/589
2015/0015599 A1* 1/2015 Yaras ..... G09G 3/2037 345/600

FOREIGN PATENT DOCUMENTS

KR 10-2009-0065429 A 6/2009
KR 10-2009-0125497 A 12/2009
KR 10-2011-0038496 A 4/2011
KR 1020140119996 10/2014

* cited by examiner

*Primary Examiner* — Ilana Spar
*Assistant Examiner* — Kirk Hermann
(74) *Attorney, Agent, or Firm* — Innovation Counsel LLP

(57) ABSTRACT

The described technology relates generally to an organic light emitting display and a method for driving the same. According to an exemplary embodiment, an image is displayed by dividing one frame into a plurality of sub-fields, and a gamma curve is realized with a combination of a plurality of sub-fields respectively corresponding to a plurality of grays of image data so that image data can be compensated without adding a memory. In addition, the embodiment can extract the one combination by setting a combination of sub-fields that exceeds one frame time among the plurality of sub-fields to be an exception condition.

8 Claims, 8 Drawing Sheets

ORGANIC LIGHT EMITTING DISPLAY DEVICE AND DRIVING METHOD THEREOF THAT DISPLAYS AN IMAGE BY DIVIDING ONE FRAME INTO A PLURALITY OF SUB-FIELDS

RELATED APPLICATIONS

This application claims priority to and the benefit of Korean Patent Application No. 10-2013-0099805 filed in the Korean Intellectual Property Office on Aug. 22, 2013, the entire contents of which are incorporated herein by reference.

BACKGROUND

1. Technical Field

The described technology relates generally to an organic light emitting display and a driving method thereof.

2. Description of the Related Art

A typical flat organic light emitting display includes a liquid crystal display (LCD), a field emission display (FED), a plasma display panel (PDP), an organic light emitting display (OLED), and the like.

In general, an organic light emitting display using an organic light emitting diode (OLED) among the flat organic light emitting displays is a flat-type display using electric field emission of an organic material. Light emission of the organic light emitting diode (OLED) is achieved using a mechanism in which electrons and holes are injected from electrodes, and when excitons generated by coupling the holes and electrons fall from an excited state to a ground state, light is emitted.

The organic light emitting display does not require an additional light source, and thus the thickness and weight thereof may be reduced. Since the organic light emitting display has a fast response speed and at the same time has excellent light emission efficiency, luminance, and viewing angle, the organic light emitting display can be used for electronic products such as a portable terminal or a large television.

The above information disclosed in this Background section is only for enhancement of understanding of the background of the described technology and therefore it may contain information that does not form the prior art that is already known in this country to a person of ordinary skill in the art.

SUMMARY

In general, an organic light emitting display compensates a luminance deviation of image data using a gamma curve. However, in order to precisely express a 2.2 gamma in low gray, about 18-bit compensation data is required. Thus, the size of a memory is increased. Therefore, an exemplary embodiment provides an organic light emitting display displaying an image by dividing one frame into a plurality of sub-fields and compensating image data without adding a memory by realizing a gamma curve with a combination of a plurality of sub-fields respectively corresponding to a plurality of grays of the image data, and a method for driving the organic light emitting display.

The organic light emitting display according to the exemplary embodiment includes: a display unit, a signal controller, a scan driver and a data driver. The display unit includes a plurality of data lines, a plurality of scan lines, and a plurality of pixels connected to the respectively corresponding data lines and scan lines. The signal controller is configured to divide externally input data by one frame unit, and configured to generate image data by arranging one frame of the input data with a plurality of sub-fields, each having a different seed value. The scan driver is configured to supply a plurality of scan signals to the plurality of scan lines for a scan period of each of the plurality of sub-fields. The data driver is configured to generate a plurality of data signals using the image data and supplies the plurality of data signals to the plurality of data lines. The signal controller is configured to arrange the sub-fields, excluding a combination including at least two sub-fields of which the sum of seed values is greater than the one frame among the plurality of sub-fields.

The signal controller may include a gamma setter setting each of a plurality of grays of the input data with a combination of sub-fields corresponding to a gamma curve. The gamma setter processes a combination that includes at least two largest seed values among the plurality of seed values as an exception condition.

Further, the gamma setter may include: a sampler, a calculator and a selector. The sampler extracts a plurality of sample combinations respectively corresponding to the plurality of grays and includes a seed value selected from a plurality of seed values. The calculator calculates a sampling luminance corresponding to the plurality of sample combinations and calculates an error value by comparing the sampling luminance and a target luminance that corresponds to the gamma curve. The selector selects a sampling combination of which an error value is included in a target error range and does not correspond to the exception condition among the plurality of sampling conditions, and stores the selected sample combination in a gamma table.

The selector selects a sample combination having the smallest error value when a plurality of sample combinations is selected. The selector adds the target luminance as a new seed value when an error value of each of the plurality of sample combinations is not included in the target error range.

In addition, according to another exemplary embodiment, a method is provided to drive an organic light emitting display. The organic light emitting display includes a display unit, a signal controller, a scan driver, and a data driver. The display unit includes a plurality of data lines, a plurality of scan lines, and a plurality of pixels connected to the corresponding data lines and the corresponding scan lines. The signal controller generates image data using externally input data. The scan driver supplies a plurality of scan signals to the plurality of scan lines for a scan period of each of a plurality of sub-fields. The data driver generates a plurality of data signals using the image data and supplies the plurality of data signals to the plurality of data lines.

The method includes: dividing the input data in one frame; setting a plurality of grays of the input data to a combination of a plurality of sub-fields, each having a different seed value; and arranging the one frame with the combination of sub-fields. The method further includes excluding a combination including at least two sub-fields of which the sum of seed values is greater than the one frame among the plurality of sub-fields.

The setting the combination of sub-fields may include: extracting a plurality of sample combinations respectively corresponding to a plurality of grays of the input data; selecting at least one sample combination among the plurality of sample combinations according to a target error range; excluding a sample combination including at least two sub-fields of which the sum of seed values is greater than the one frame among the selected sample combinations; and storing the sample combination in a gamma table.

In addition, the extracting the plurality of sample combinations may include selecting a part of the plurality of seeds values for combination. The selecting the sample combination may include: calculating a sampling luminance by adding the seed value of each of the plurality of sample combinations; calculating an error value by comparing a target luminance corresponding to a gamma curve with the sample luminance; and determining whether the error value is included in the target error range.

In addition, the storing the sample combination in the gamma table may include updating the gamma table with a sample combination having the smallest error value among the sample combinations of which error values are included in the target error range.

When the error value of each of the plurality of sample combinations is not included in the target error range, the target luminance may be added as a new seed value.

According to the exemplary embodiment, an image is displayed by dividing one frame into a plurality of sub-fields, and a gamma curve is realized with a combination of a plurality of sub-fields respectively corresponding to a plurality of grays of image data so that image data can be compensated without adding a memory.

In addition, the exemplary embodiment can extract the one combination among the plurality of sub-fields to be an exception condition by setting a combination of sub-fields that exceeds one frame time.

DETAILED DESCRIPTION OF THE EMBODIMENTS

Figure 1:
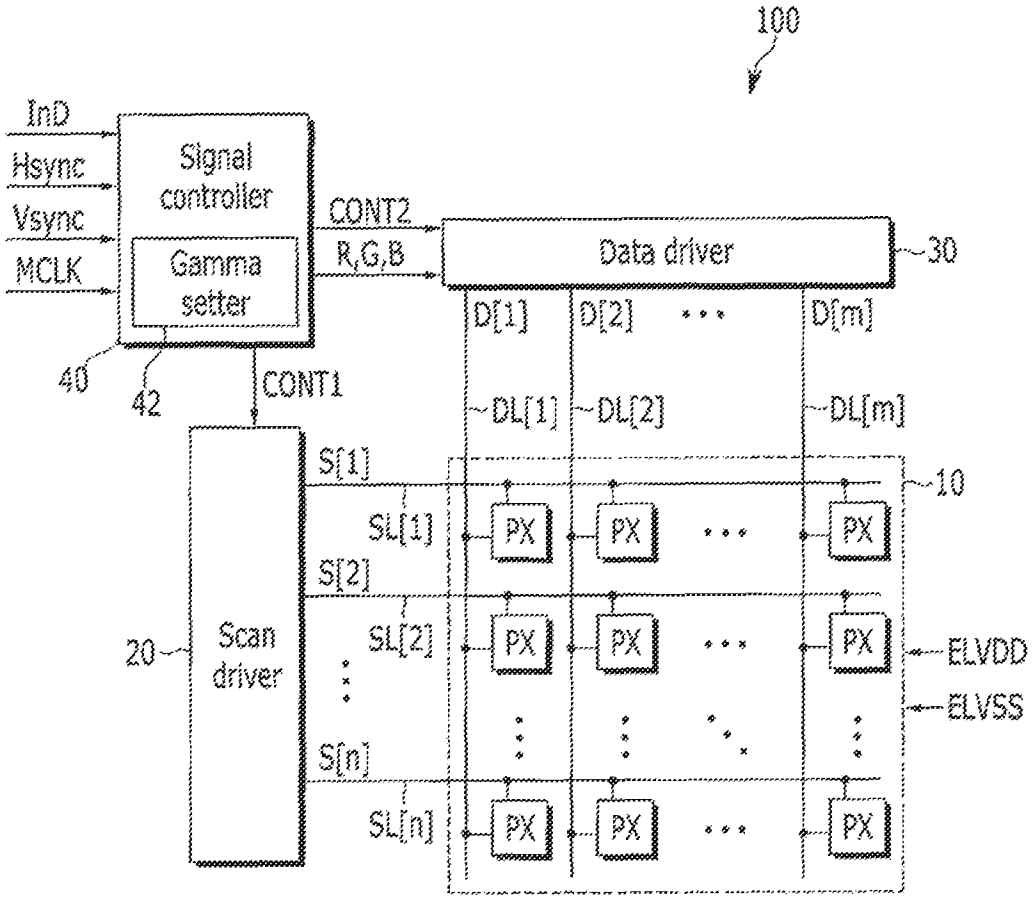
FIG. 1 is a block diagram of an organic light emitting diode (OLED) display according to an exemplary embodiment.

In the following detailed description, the exemplary embodiments have been shown and described, simply by way of illustration. As those skilled in the art would realize, the described embodiments may be modified in various different ways, all without departing from the spirit or scope of the exemplary embodiments. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

The exemplary embodiments will be described more fully hereinafter with reference to the accompanying drawings, in which exemplary embodiments are shown.

Figure 2:
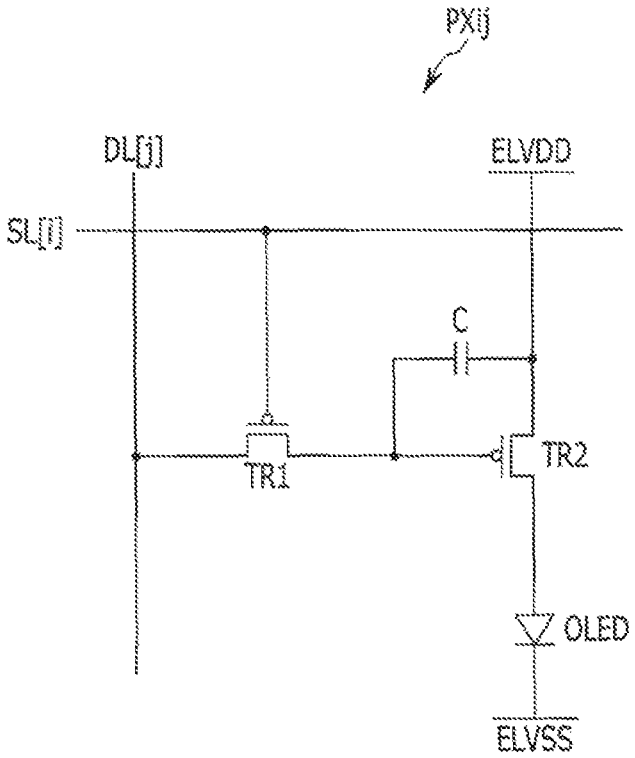
FIG. 2 is an equivalent circuit diagram of a pixel according to the exemplary embodiment.

FIG. 1 is a block diagram of an organic light emitting display according to an exemplary embodiment, and FIG. 2 is an equivalent circuit diagram of a pixel PXij according to the exemplary embodiment.

Referring to FIG. 1, an organic light emitting display 100 according to the exemplary embodiment includes a display unit 10, a scan driver 20, a data driver 30, and a signal controller 40.

The display unit 10 is a display area including a plurality of pixels PX, and a plurality of scan lines SL[1] to SL[n], a plurality of data lines DL[1] to DL[m], and wires for applying power source voltages ELVDD and ELVSS are formed in the pixels PX.

Each of the plurality of pixels PX includes a red sub-pixel emitting red light, a green sub-pixel emitting green light, and a blue sub-pixel emitting blue light so that it can display an image with various colors.

For example, as shown in FIG. 2, a pixel PXij connected to an i-th scan line SL[i] and a j-th data line DL[j] includes a switching transistor TR1, a driving transistor TR2, a capacitor C, and an organic light emitting diode OLED.

The switching transistor TR1 includes a gate electrode connected to the scan line SL[i], a source electrode connected to the data line DL[j], and a drain electrode connected to a gate electrode of the driving transistor TR2.

The driving transistor TR2 includes a source electrode connected to a wire applying a power source voltage ELVDD, a drain electrode connected to an anode of a red organic light emitting diode OLED, and a gate electrode to which a voltage Vdata corresponding to a data signal D[j] is transmitted during a turn-on period of the switching transistor TR1.

The capacitor C is connected between the gate electrode and the source electrode of the driving transistor TR2. A cathode of the organic light emitting diode OLED is connected to a wire applying a power source voltage ELVSS.

In the pixel PX having such a configuration, the data voltage Vdata is transmitted to the gate electrode of the driving transistor TR2 when the switching transistor TR1 is turned on by the scan signal S[i]. A voltage difference between the gate electrode and the source electrode of the driving transistor TR2 is maintained by the capacitor C, and a driving current Id flows to the driving transistor TR2. The organic light emitting diode OLED emits light according to the driving current Id. Meanwhile, in the exemplary embodiment, the pixel PX shown in FIG. 2 is an exemplary pixel of the display, and a different type of pixel may be used.

Referring back to FIG. 1, the scan driver 20 is connected to the plurality of scan lines SL[1] to SL[n], and generates a plurality of scan signals S[1] to S[n] according to a first driving control signal CONT1. The scan driver 20 transmits the scan signals S[1] to S[n] to the respective scan lines S[1] to S[n]. The scan driver 20 may generate the plurality of scan signals S[1] to S[n] for every scan period of each of a plurality of sub-fields included in one frame.

The data driver 30 samples image data R, G, and B according to a second driving control signal CONT2, and latches the sampled data to generate a plurality of data signals D[1] to D[m]. The data driver 30 transmits the data signals D[1] to D[m] to the respectively corresponding data lines DL[1] to DL[m].

The signal controller 40 receives an external synchronization signal and processes the signal to generate the first and second driving control signals CONT1, and CONT2.

Here, the synchronization signal includes a horizontal synchronization signal Hsync, a vertical synchronization signal Vsync, and a main clock signal MCLK.

In addition, the signal controller 40 divides input data InD by every frame unit, and generates image data R, G, and B by arranging one frame of the input data InD in a plurality of sub-fields, each having a different seed value.

Thus, the signal controller 40 includes a gamma setter 42 setting a combination of a sub-field corresponding to each of a plurality of grays of the input data InD. Here, the seed value is a time weight corresponding to a gray that cannot express luminance itself with a combination of other grays among the plurality of grays of the input data InD.

The gamma setter 42 may exclude a combination of sub-fields that satisfy a predetermined exception condition. Here, exception condition may be set to a combination that simultaneously includes at least two sub-fields of which the sum of seed values exceeds one frame time among the plurality of sub-fields.

Figure 3:
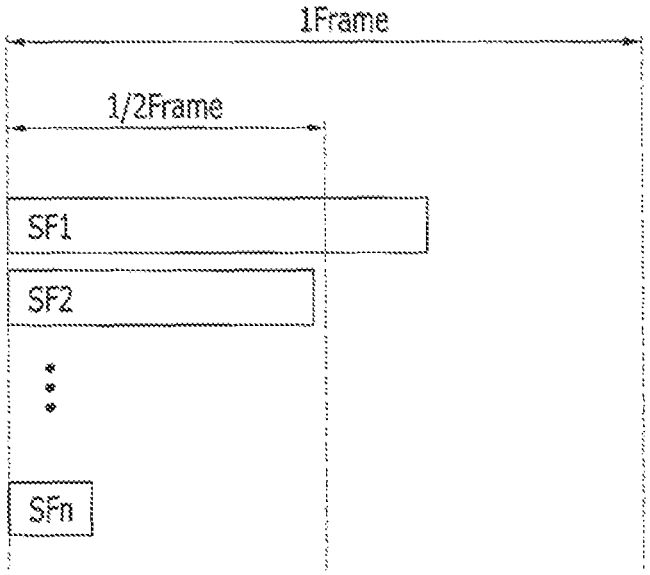
FIG. 3 illustrates a sub-frame.

That is, when a combination of sub-fields includes at least two seed values which are the largest and second largest in size, the corresponding combination satisfies the exception condition. For example, when an index is assigned to each of the plurality of seed values from the largest in size, as shown in FIG. 3, a combination including a first sub-field SF1 and a second sub-field SF2 satisfies the exception condition if the first sub-field SF1 is the largest in size and the second field SF2 is the second largest in size among the plurality of sub-fields SF1 to SFn. The gamma setter 42 may limit the number of sub-fields that exceeds half the frame to 1 or 2 among the plurality of sub-fields SF1 to SFn.

In addition, the gamma setter 42 can reduce the seed value with a constant ratio if a total time of the corresponding combination exceeds one frame time even through the sub-field combination does not exceed the exception condition.

Figure 4:
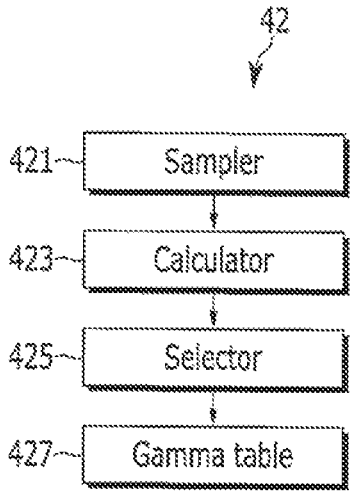
FIG. 4 is a detailed block diagram of a gamma setter of FIG. 1.

FIG. 4 is a detailed block diagram of the gamma setter 42 of FIG. 1.

Referring to FIG. 4, the gamma setter 42 according to the exemplary embodiment includes a sampler 421, a calculator 423, a selector 425, and a gamma table 427. Here, the sampler 421 extracts a plurality of sample combinations corresponding to the plurality of grays respectively of the input data InD by using the plurality of seed values. Each of the plurality of sample combinations is selected with a random number of seed values among the entire seed values, and includes a plurality of seed values regardless of the order.

The calculator 423 calculates a sampling luminance by adding a seed value of each of the extracted plurality of sample combinations. In addition, the calculator 423 calculates an error value by comparing the sampling luminance and a predetermined target luminance. Here, the target luminance corresponds to a gamma curve.

The selector 425 selects a sample combination of which an error value between the sampling luminance and the target luminance is included in a target error range and does not satisfy the exception condition among the plurality of sample combinations. Here, the selector 425 may select a sample combination of which the error value between the sampling luminance and the target luminance is the smallest among a plurality of selected sample combinations. The selector 425 stores the selected sample combination in the gamma table 427.

In addition, when the error value between the sample luminance and the target luminance of all sample combinations is not included in the target error range, the selector 425 adds a target luminance of the corresponding gray as a new seed value and stores the added seed value in the gamma table 427.

Figure 5:
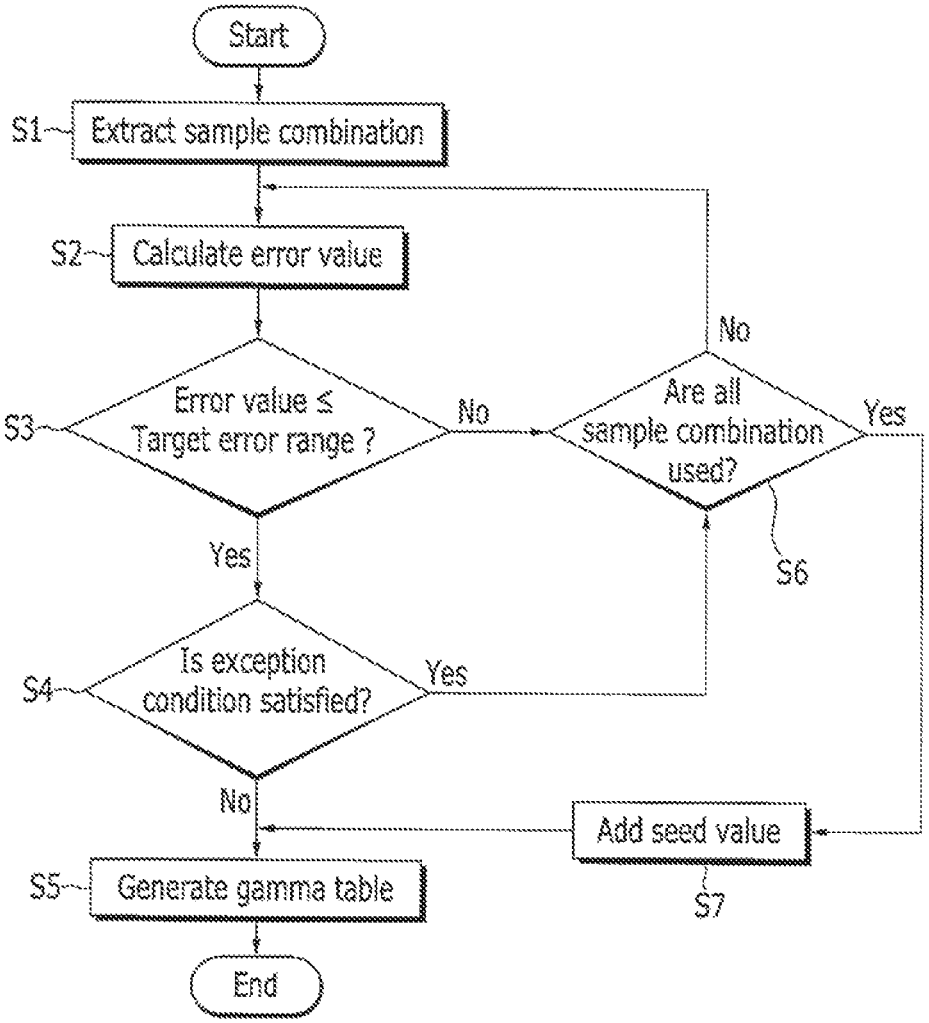
FIG. 5 is a flowchart of a driving process of the OLED display according to the exemplary embodiment.

FIG. 5 is a flowchart of a driving method of the organic light emitting display according to the exemplary embodiment.

Referring to FIGS. 4 and 5, the sampler 421 searches a plurality of seed values. The sampler 421 selects a random number of seed values among the plurality of seed values to extract a plurality of sample combinations Cset that respectively correspond to a plurality of grays (operation S1). For example, when the input data InD is 8-bit data, the sampler 421 extracts a plurality of sample combinations Cset that respectively correspond to 0 to 255 grays.

Then, the calculator 423 calculates a sampling luminance Cal_val(i) by adding a seed value of each of the extracted plurality of sample combinations Cset. In addition, the calculator 423 calculates an error value by comparing the sampling luminance Cal_val(i) and a predetermined target luminance target(i) (operation S2).

Then, the selector 425 determines whether the calculated error value (|target(i)−Cal_val(i)|) is included in a target error range (target(i)*error (%)) (operation S3). When the error value is included in the error range, the selector 425 determines whether the corresponding sample combination Cset satisfies the exception condition (operation S4). For example, when a first seed value corresponds to a target luminance of gray 239, a sample combination Cset of gray 240 may include the first seed value as a default value. In this case, a combination including both of the first seed value and a second seed value exists in a plurality of sample combinations Cset extracted corresponding to the gray 240, the selector 425 may determine that the corresponding sample combination Cset satisfies the exception condition.

Then, when the exception condition is not satisfied according to the determination result in operation S4, the selector 425 stores the corresponding sample combination Cset as a random variable in the gamma table 427 (operation S5). In this case, when a sample combination having an error value that is smaller than an error value of the sample combination Cset stored as a variable is newly searched, the gamma table 427 is updated with the corresponding sample combination Cset. That is, the selector 425 generates the gamma table 427 with a sample combination having the smallest error value among error values of all sample combinations Cset.

Meanwhile, when the result of the determination in operation S3 shows that the calculated error value is not included in the target error range, the selector 425 determines whether all available sample combinations Cset are used (operation S6). When the result of the determination shows that any value with respect to the entire extractable sample combinations Cset is not included in the target error range, the selector 425 adds a target luminance of the corresponding gray as a new seed value and stores the added seed value in the gamma table 427 (operation S7). Through such a process, the selector 425 can select the one sample combination Cset that corresponds to each of the plurality of grays of the input data InD.

Figure 6:
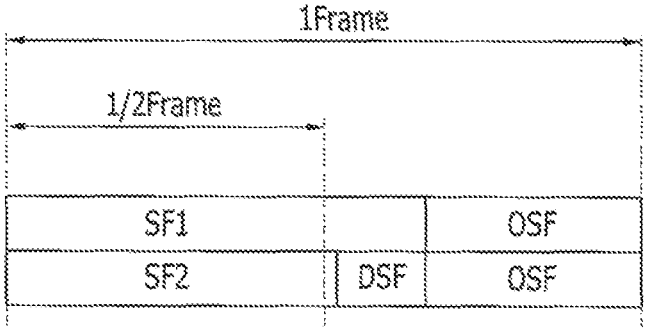
FIGS. 6, 7, and 8 illustrate alignment of sub-fields according to the exemplary embodiments.
Figure 7:
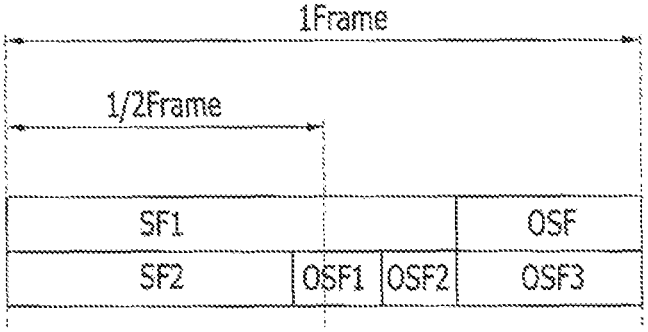
Figure 8:
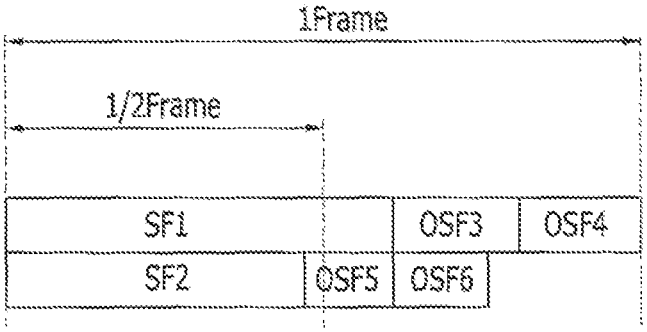

FIG. 6 to FIG. 8 are provided for description of alignment of the sub-fields according to the exemplary embodiments.

Referring to FIG. 6, in one frame time, sub-fields may be divided into a first sub-field SF1 and a plurality of other sub-fields OSF. For example, the first sub-field SF1 is longer than half a frame and a second sub-field SF2 is half a frame. If a combination of sub-fields that correspond to a specific gray includes the second sub-field SF2 and the plurality of other sub-fields OSF, a dummy sub-field DSF in which light is not emitted may be arranged for a time period that corresponds to a difference between the first sub-field SF1 and the second sub-field SF2.

In addition, referring to FIG. 7, when the second sub-field SF2 is used instead of the first sub-field SF1, a time period that corresponds to the time period of the first sub-field SF1 may be corresponded to by arranging the second sub-field SF2 and other sub-fields OSF1 and OSF2. As the number of arranged sub-fields is increased, the probability that the total of sub-fields exceeds one frame time may be decreased.

In addition, referring to FIG. 8, the display can be driven for one frame period by setting the first sub-field SF1 as a default value and arranging a plurality of other sub-fields OSF3 and OSF4. In the exemplary embodiment, the total of sub-fields may be shorter than one frame period if the combination is determined to be the best combination of sub-fields. For example, the organic light emitting display can be driven by arranging the second sub-field and a plurality of sub-fields OSF5 and OSF6.

While this disclosure has been described in connection with what is presently considered to be practical exemplary embodiments, it is to be understood that the inventive concept is not limited to the disclosed embodiments, but, on the contrary, is intended to cover various modifications and equivalent arrangements included within the spirit and scope of the appended claims.

What is claimed is:

1. An organic light emitting display comprising:

a display unit including a plurality of data lines, a plurality of scan lines, and a plurality of pixels connected to the respectively corresponding data lines and scan lines;

a signal controller configured to divide externally input data by one frame unit, and configured to generate image data by arranging one frame of the input data with a plurality of sub-fields, each having a different seed value;

a scan driver configured to supply a plurality of scan signals to the plurality of scan lines for a scan period of each of the plurality of sub-fields; and a data driver configured to generate a plurality of data signals using the image data and supplying the plurality of data signals to the plurality of data lines, wherein the signal controller is configured to arrange the sub-fields, excluding a combination including at least two sub-fields of which the sum of seed values is greater than the one frame among the plurality of sub-fields, wherein the signal controller comprises a gamma setter configured to set each of a plurality of grays of the input data with a combination of sub-fields corresponding to a gamma curve, wherein the gamma setter is configured to process a combination that includes at least two largest seed values among the plurality of seed values as an exception condition, and wherein the gamma setter comprises:

a sampler configured to extract a plurality of sample combinations respectively corresponding to the plurality of grays and including a seed value selected from a plurality of seed values;

a calculator configured to calculate a sampling luminance corresponding to the plurality of sample combinations and configured to calculate an error value by comparing the sampling luminance and a target luminance that corresponds to the gamma curve; and a selector configured to select a sampling combination of which an error value is included in a target error range and does not correspond to the exception condition among the plurality of sampling conditions, and configured to store the selected sample combination in a gamma table.

2. The organic light emitting display of claim 1, wherein the selector is configured to select a sample combination having the smallest error value when a plurality of sample combination are selected.

3. The organic light emitting display of claim 1, wherein the selector is configured to add the target luminance as a new seed value when an error value of each of the plurality of sample combinations is not included in the target error range.

4. A method for driving an organic light emitting display, the organic light emitting display comprising:

a display unit including a plurality of data lines, a plurality of scan lines, and a plurality of pixels connected to the corresponding data lines and the corresponding scan lines;

a signal controller generating image data using externally input data;

a scan driver supplying a plurality of scan signals to the plurality of scan lines for a scan period of each of a plurality of sub-fields; and a data driver generating a plurality of data signals using the image data and supplying the plurality of data signals to the plurality of data lines, the method comprising:

dividing the input data in one frame;

setting a plurality of grays of the input data to a combination of a plurality of sub-fields, each having a different seed value; and arranging the one frame with the combination of sub-fields, wherein a combination including at least two sub-fields of which the sum of seed values is greater than the one frame among the plurality of sub-fields is excluded, and wherein the setting comprises:

extracting a plurality of sample combinations respectively corresponding to the plurality of grays of the input data;

selecting at least one sample combination among the plurality of sample combinations according to a target error range;

excluding a sample combination including at least two sub-fields of which the sum of seed values is greater than the one frame among the selected sample combinations; and storing the sample combination in a gamma table.

5. The method for driving the organic light emitting display of claim 4, wherein the extracting comprises selecting a part of the plurality of seed values for combination.

6. The method for driving the organic light emitting display of claim 4, wherein the selecting comprises:

calculating a sampling luminance by adding the seed value of each of the plurality of sample combinations;

calculating an error value by comparing a target luminance corresponding to a gamma curve with the sample luminance; and determining whether the error value is included in the target error range.

7. The method for driving the organic light emitting display of claim 6, wherein the storing the sample combination in the gamma table comprises updating the gamma table with a sample combination having the smallest error value among the sample combinations of which error values are included in the target error range.

8. The method for driving the organic light emitting display of claim 6, further comprising, when the error value of each of the plurality of sample combinations is not included in the target error range, adding the target luminance as a new seed value.

* * * * *